US007281959B2

(12) United States Patent
Gerving

(10) Patent No.: US 7,281,959 B2
(45) Date of Patent: Oct. 16, 2007

(54) CONTACTOR EQUIPPED WITH BOX TERMINALS

(75) Inventor: Karsten Gerving, Bonn (DE)

(73) Assignee: Moeller GmbH, Bonn (DE)

( * ) Notice: Subject to any disclaimer, the term of this patent is extended or adjusted under 35 U.S.C. 154(b) by 5 days.

(21) Appl. No.: 10/575,927

(22) PCT Filed: Sep. 27, 2004

(86) PCT No.: PCT/EP2004/052321

§ 371 (c)(1),
(2), (4) Date: Apr. 14, 2006

(87) PCT Pub. No.: WO2005/038845

PCT Pub. Date: Apr. 28, 2005

(65) Prior Publication Data

US 2007/0128921 A1 Jun. 7, 2007

(30) Foreign Application Priority Data

Oct. 16, 2003 (DE) ..... 103 48 088

(51) Int. Cl.
*H01R 33/05* (2006.01)

(52) U.S. Cl. ..... 439/712

(58) Field of Classification Search ..... 439/709, 439/712, 715, 716, 717, 718
See application file for complete search history.

(56) References Cited

U.S. PATENT DOCUMENTS 4,776,815 A * 10/1988 Baillet et al. ..... 439/724
4,832,628 A * 5/1989 Huska ..... 439/716
4,854,897 A * 8/1989 Grobbel ..... 439/716
4,872,092 A * 10/1989 Lush et al. ..... 361/823
4,940,431 A * 7/1990 Hennemann ..... 439/716
5,049,094 A * 9/1991 Heng et al. ..... 439/716
5,090,922 A * 2/1992 Rymer et al. ..... 439/716
5,299,957 A * 4/1994 Schaeffer ..... 439/712
5,411,417 A * 5/1995 Horn et al. ..... 439/709
5,641,313 A * 6/1997 Hohorst ..... 439/709

(Continued)

FOREIGN PATENT DOCUMENTS

DE 39 32 502 4/1990

(Continued)

OTHER PUBLICATIONS

Siemens Company Catalog No. LV10 2004 "Schaltgeräte für die Industrie" [Controlgear for Industry], dated Aug. 26, 2003, pp. 2/1, 2, 3, 5, 53, 54, 97, 98, 229, 15/44 [Discussed in specification].

(Continued)

*Primary Examiner*—Ross Gushi
(74) *Attorney, Agent, or Firm*—Darby & Darby

(57) ABSTRACT

A contactor includes an upper housing part (2), connecting bars (8) that are fixed in the upper housing part, a front housing cover and box terminals (20) that are located in terminal housings. To simplify the connection technique for the contactor, the housing cover has two right-angled cover halves (4, 6), whose respective front cover limbs (16) lie opposite one another in close proximity and which can be fixed onto the upper housing part (2). The cover limbs (18) of the housing cover on the connection side are configured as terminal housings.

7 Claims, 2 Drawing Sheets

U.S. PATENT DOCUMENTS

| | | | | |
|---|---|---|---|---|
| 5,658,172 | A * | 8/1997 | Schmidt et al. | 439/716 |
| 5,735,700 | A * | 4/1998 | Hohorst | 439/98 |
| 5,745,338 | A * | 4/1998 | Bartolo et al. | 361/637 |
| 5,775,955 | A * | 7/1998 | Graube et al. | 439/717 |
| 5,820,420 | A * | 10/1998 | Bechaz et al. | 439/716 |
| 5,836,791 | A * | 11/1998 | Waas et al. | 439/709 |
| 5,993,267 | A * | 11/1999 | Lin | 439/709 |
| 6,074,240 | A * | 6/2000 | Bradshaw et al. | 439/412 |
| 6,146,213 | A * | 11/2000 | Yoon | 439/716 |
| 6,478,605 | B2 * | 11/2002 | Stuckmann et al. | 439/409 |
| 7,134,922 | B2 * | 11/2006 | Kim | 439/814 |
| 7,192,316 | B1 * | 3/2007 | Pollmann | 439/716 |
| 2003/0045178 | A1 * | 3/2003 | Huiskamp et al. | 439/709 |
| 2003/0139099 | A1 * | 7/2003 | Ude et al. | 439/715 |
| 2005/0079773 | A1 * | 4/2005 | Prokup et al. | 439/709 |

FOREIGN PATENT DOCUMENTS

| | | |
|---|---|---|
| DE | 195 14 842 | 10/1996 |
| DE | 69 800 453 T2 | 4/2001 |
| EP | 0 880 198 | 11/1998 |
| EP | 0 896 387 | 2/1999 |

OTHER PUBLICATIONS

International Search Report for PCT/EP2004/052321.

* cited by examiner

CONTACTOR EQUIPPED WITH BOX TERMINALS

The present invention relates to a contactor having box terminals.

BACKGROUND

Publication DE 3932502A1describes a three-pole contactor having a switching device housing including a bottom housing part, a top housing part and a housing cover. Contact straps protrude from the top housing part on each terminal side, the ends of said contact straps being surrounded by box terminals. The metallic box terminals are composed of a clamping box, a clamping bracket, and a clamping screw. On each terminal side, the box terminals are supported in a box-shaped terminal housing. The terminal housings are attachable to the top housing part via hook-shaped projections and are provided, on the terminal side, with insertion openings for conductors to be connected and, on the front side, with access openings for a screw tool for operating the clamping screws. According to EP 880198A2, such box terminals are held via their clamping box by means of knobs on the inner walls of the terminal housing.

In a 3RT10, S3 type contactor made by the Siemens Company (company catalog no. LV10 2004 "Controlgear for Industry", dated Aug. 26, 2003, pages 2/3, 5, 54, 98, 229), box terminals are inserted into a terminal housing toward the front side, held via their clamping boxes by means of knobs formed on the inner walls of the terminal housings, and slid from the terminal side over contact straps protruding out of a top housing part. The terminal housings can be latched to the top housing part by suitable latch means. A housing cover, which is to be attached with two screws, is placed onto the top housing part between the two terminal housings, thereby locking the terminal housings in place. In a 3RT10, S2 type contactor, also of the Siemens Company (ibid, pages 2/2, 5, 53, 97, 229), the box terminals are inserted into box terminals from the front side. The terminal housings latched to the top housing part are covered and locked in place on the front side by a housing cover which provided with access openings to the clamping screws and is to be attached to the top housing part with two screws.

DE 195 14 842A1discloses a process connector whose enclosure is composed of a base part onto which is placed a cover to complete the enclosure; the placement of the cover being carried out after a printed circuit board has been inserted. The U-shaped cover is adapted to receive a multicontact process connector. Connection elements of this type are not suitable for high currents and mechanical loads, such as occur at connecting terminals of contactors.

DE698 00 453 T2 (EP896 387B1) discloses a multipole electrical switching device having a switching device housing (not further detailed) and contact straps protruding from the terminal side thereof. Box terminals, which are received in a box-like terminal housing, have to be slid over the contact straps.

The terminal housing is attachable to the switching device housing and closable on the terminal side by a removable cover provided with cable entry openings.

SUMMARY OF THE INVENTION

To complete the known contactors in terms of their connection system, two terminal housings and one housing cover, which is to be attached to the top housing part, need to be installed in each case. In view of the above, it is the object of the present invention to simplify the completion of the connection system.

In accordance with the present invention, the terminal housings are integrated into a two-part housing cover, thereby reducing by one-third the number of housing parts needed to complete the connection system. The cover halves equipped with the box terminals can be attached to the top housing part in a simple manner.

For the assembly of the cover halves and the top housing part, it is advantageous to provide the side walls and the terminal housings with guide means and mating guide means, which are brought into operative contact, especially into clamping contact, with each other; in particular, to provide the side walls with guide ribs running parallel to the front side, and to provide the cover halves with guide grooves.

In an advantageous refinement of the present invention, the terminal-side cover legs, which are designed as terminal housings, are laterally embraced by the sidewalls of the top housing part, forming a snap-fit connection. In this connection, it is also advantageous if the side walls have formed therein the mating latch means that cooperate with the latch means provided on the terminal-side cover legs.

BRIEF DESCRIPTION OF THE DRAWINGS

Further details and advantages of the present invention will become apparent from the exemplary embodiment described below with reference to the Figures, in which.

DETAILED DESCRIPTION OF ANEMBODIMENT

Figure 1:
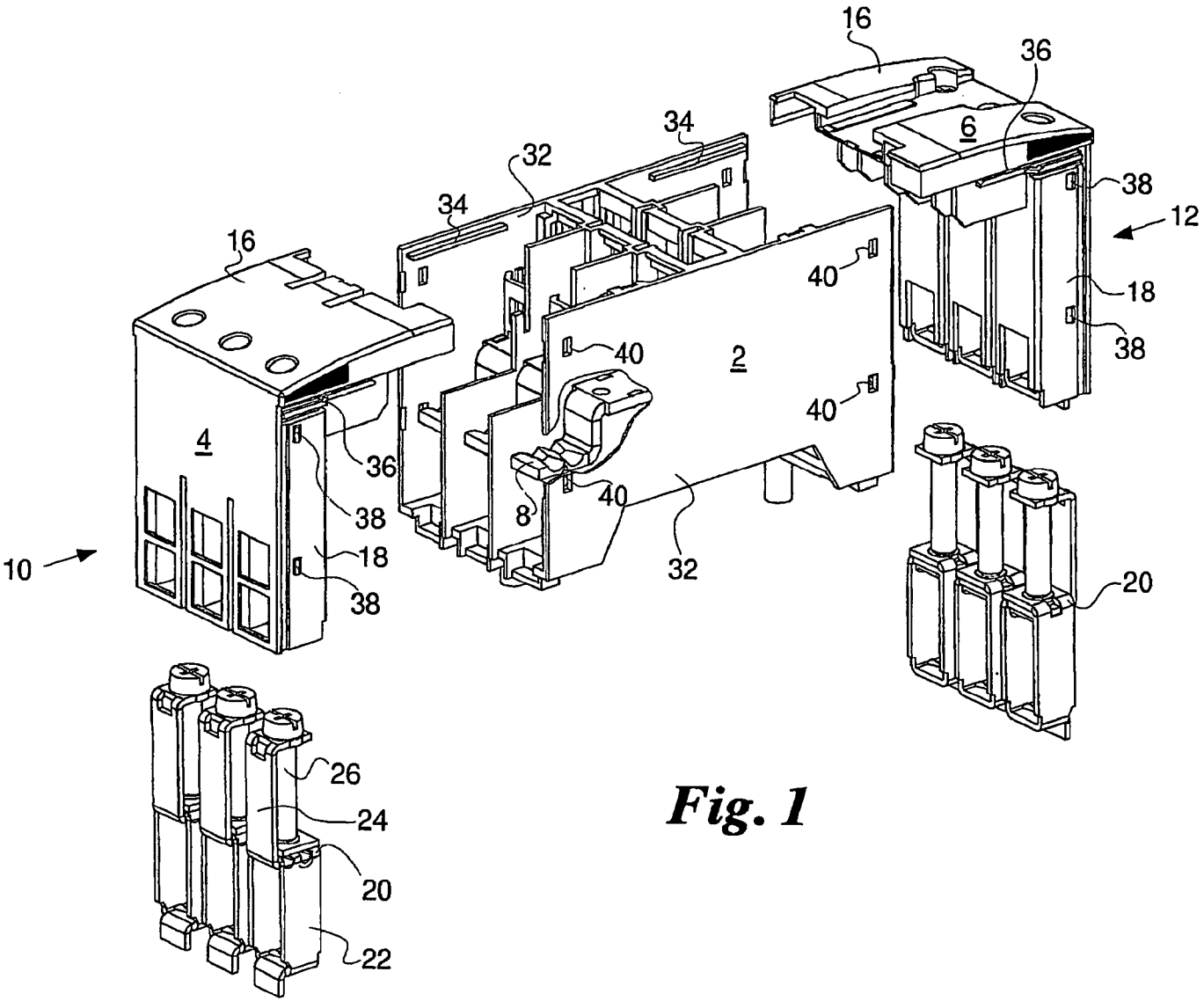
FIG. 1 is an exploded view of the upper part of a contactor according to the present invention.
Figure 2:
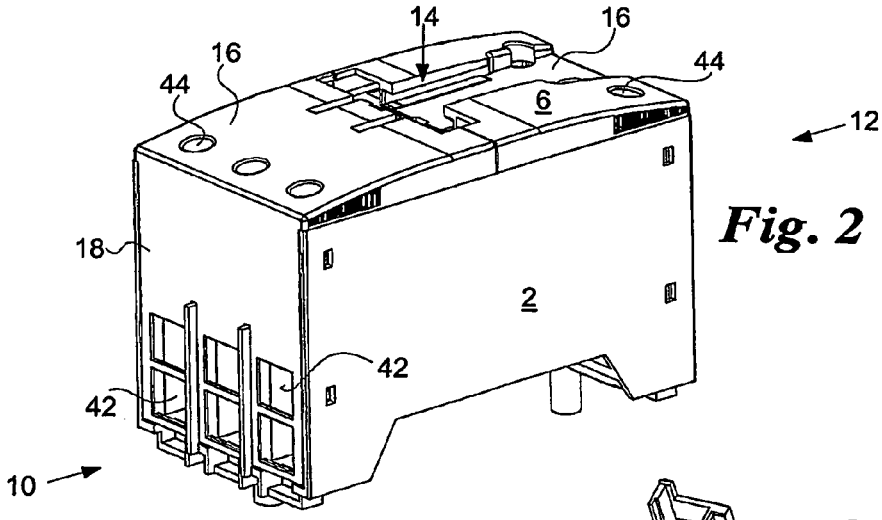
FIG. 2 is an assembled view of the contactor according to FIG. 1.

FIG. 1 and FIG. 2 show a top housing part 2 and two cover halves 4 and 6, which form part of the switching device housing of the three-pole contactor of the present invention. Top housing part 2 is placed onto a bottom housing part, which accommodates the electromagnetic operating mechanism of the contactor. Contact straps 8 are secured in top part 2, said contact straps protruding outward on terminal sides 10 and 12, respectively. Inside top housing part 2, contact straps 8 end with stationary contacts, which are connected and disconnected polewise by contact bridges, said contact bridges being operated by the electromagnetic operating mechanism.

Cover halves 4 and 6 take the form of three-dimensional, right-angled members facing opposite each other. Cover halves 4 and 6 each include a front side cover leg 16 which is level with front side 14 of the contactor, and a terminal-side cover leg 18 which is level with the respective terminal side 10 or 12.

Figure 3:
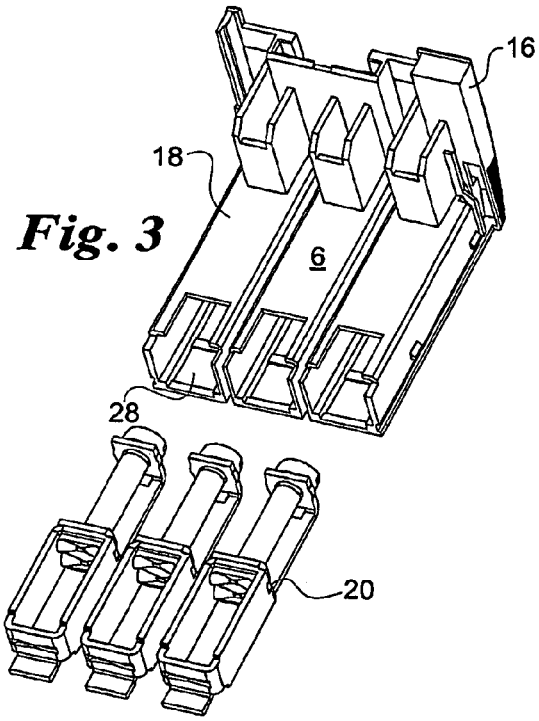
FIG. 3 shows a cover half including the box terminals to be received, looking in a direction different from that in FIG. 1 and FIG. 2.
Figure 4:
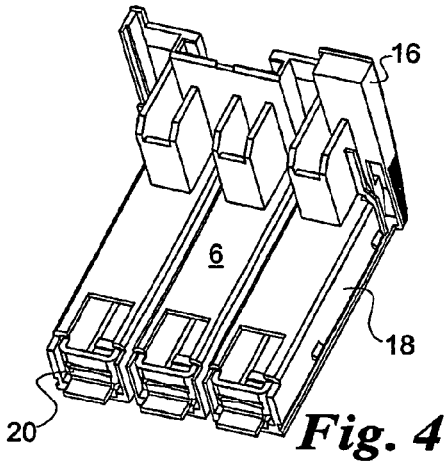
FIG. 4 shows a cover half equipped with box terminals, looking in the same direction as in FIG. 3.
Figure 5:
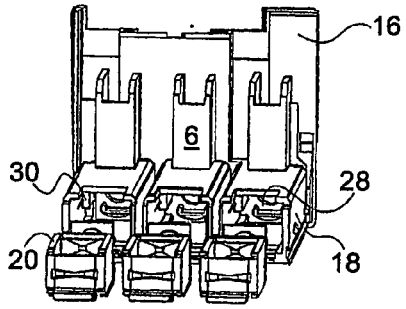
FIG. 5 shows the cover half including the box terminals to be received, looking in a direction different from that in FIG. 3.

Moreover, each terminal side 10 and 12 is provided with three box terminals 20. In usual fashion, metallic box terminals 20 are composed of a clamping box 22, a clamping bracket 24, and a clamping screw 26. According to FIG. 3 and FIG. 5, the box-shaped terminal-side cover legs 18 have parallelepiped-shaped receiving chambers 28 into which box terminals 20 are inserted opposite the front side 14. Thus, terminal-side cover legs 18 serve as a terminal housing. According to FIG. 5, the inner walls of receiving chambers 28 are provided with pointed nose-shaped knobs 30, between which box terminals 20 are clampingly held via their clamping boxes 22.

The cover halves 4 and 6 equipped with box terminals 20 are slid onto top housing part 2 with a lateral movement toward contact straps 8. In the process, contact straps 8 are surrounded by clamping boxes 22. The inner sides of opposite side walls 32 of top housing part 2 are provided with guide means 34 taking the form of guide ribs and running parallel to front side 14. The lateral outer surfaces of front-side cover leg 16 are provided with mating guide means 36 taking the form of guide grooves and running parallel to front side 14. During the sliding-on of cover halves 4 and 6, guide means 34 are engaged with mating guide means 36. The lateral outer surfaces of terminal-side cover legs 18 each have formed thereon two latch means 38 in the form of latch knobs. During the sliding-on of cover halves 4 and 6, said latch means snap into two respective mating latch means 40 provided in the form of latch openings on the side walls 32, thereby firmly holding cover halves 4 and 6 on top housing part 2.

In the fully assembled condition of the contactor, the ends of conductors to be connected are inserted into box terminals 20 through insertion openings 42 formed in terminal-side cover legs 18. Subsequently, the conductor ends are firmly clamped by tightening clamping screws 26 using a screw tool, which is inserted through access openings 44 provided in front-side cover legs 16.

What is claimed is:

1. A box-terminal contactor comprising:

a switching device housing including a housing part having a front side and two terminal sides and box terminal housings capable of being latched to the housing part from the terminal sides, contact straps secured in the housing part and laterally protruding therefrom; and box terminals held in the box terminal housings and surrounding the contact straps;

the box terminal housings including two substantially right-angled cover halves with front-side cover legs located opposite each other to cover the front side and terminal-side cover legs attachable to the housing part.

2. The contactor as recited in claim 1 wherein the guides are inwardly projecting ribs, and the mating guides are grooves.

3. The contactor as recited in claim 1 wherein the housing part includes side walls with guides running parallel to the front side and perpendicular to the terminal sides and cooperating with mating guides formed on the front-side cover legs.

4. The contactor as recited in claim 3 wherein the guides cooperate with the mating guides in a clamping manner.

5. The contactor as recited in claim 1 wherein the housing part includes side walls laterally embracing the terminal-side cover legs and latch to the terminal-side cover legs.

6. The contactor as recited in claim 5 wherein the terminal-side cover legs have a latch part cooperating with a mating latch part provided on the side walls.

7. The contactor as recited in claim 6 wherein the latch part is a latch knob and the mating latch part is an opening.

* * * * *